US005960235A

United States Patent [19]

Lee

[11] Patent Number: 5,960,235

[45] Date of Patent: Sep. 28, 1999

[54] METHOD FOR PREVENTING CONTAMINATION OF PHOTOSENSITIVE DRUM

[75] Inventor: Young-Seob Lee, Seoul, Rep. of Korea

[73] Assignee: SamSung Electronics Co., Ltd., Suwon, Rep. of Korea

[21] Appl. No.: 09/073,860

[22] Filed: May 7, 1998

[30] Foreign Application Priority Data

May 7, 1997 [KR] Rep. of Korea ..... 97-17554

[51] Int. Cl.[6] ..... G03G 15/00

[52] U.S. Cl. ..... 399/90

[58] Field of Search ..... 399/88, 90, 38

[56] References Cited

U.S. PATENT DOCUMENTS

| | | | |
|---|---|---|---|
| 3,722,992 | 3/1973 | Zweig . | |
| 3,909,258 | 9/1975 | Kotz . | |
| 3,918,971 | 11/1975 | Zweig . | |
| 4,330,199 | 5/1982 | Komori . | |
| 4,444,864 | 4/1984 | Takahashi . | |
| 4,448,867 | 5/1984 | Ohkubo et al. . | |
| 4,674,860 | 6/1987 | Tokunaga et al. . | |
| 4,870,460 | 9/1989 | Harada et al. . | |
| 4,954,843 | 9/1990 | Oka . | |
| 5,101,234 | 3/1992 | Suzuki et al. | 399/161 |
| 5,309,207 | 5/1994 | Omori . | |
| 5,339,141 | 8/1994 | Suzuki . | |
| 5,500,720 | 3/1996 | Karasawa . | |
| 5,517,289 | 5/1996 | Ito et al. | 399/149 |
| 5,708,942 | 1/1998 | Sugiyama . | |

*Primary Examiner*—Arthur T. Grimley
*Assistant Examiner*—Greg Moldafsky
*Attorney, Agent, or Firm*—Robert E. Bushnell, Esq.

[57] ABSTRACT

A method for preventing contamination of a photosensitive drum in an image forming apparatus. To prevent contamination, the apparatus cuts off a ground path between the photosensitive drum and ground upon receiving an initial print command, until an initial area of the photosensitive drum, which initially contacts the charging roller, reaches a developing position where the photosensitive drum contacts a developing roller. After the initial area has reached the developing position, the apparatus connects the photosensitive drum to ground. In this way, the surface of the photosensitive drum does not have an electric potential so that toner is not transferred to the photosensitive drum until the uncharged area reaches the developing position or the area which is exposed during the initialization of the exposure unit reaches the developing position.

11 Claims, 4 Drawing Sheets

METHOD FOR PREVENTING CONTAMINATION OF PHOTOSENSITIVE DRUM

CLAIM OF PRIORITY

This application makes reference to, incorporates the same herein, and claims all benefits accruing under 35 U.S.C. §119 from an application for *METHOD FOR PREVENTING CONTAMINATION OF PHOTOSENSITIVE DRUM* earlier filed in the Korean Industrial Property Office on the $7^{th}$ of May 1997 and there duly assigned Serial No. 17554/97.

BACKGROUND OF THE INVENTION

1. Technical Field

The present invention relates to an electrophotographic image forming apparatus, and in particular, to a method for preventing the interior of the image forming apparatus from being contaminated.

2. Related Art

In general, an electrophotographic process is widely employed for an image forming apparatus such as a copier, a laser beam printer (LBP), a LPH (LED Print Head) printer, and a facsimile using a plain paper. Such an electrophotographic process consists of the successive steps of charging →exposing →developing →transferring →fixing.

As discussed in more detail below, prior electrophotographic process is burdened by several disadvantages. Notable among these disadvantages is contamination of the photosensitive drum, causing formation of a background image as well as contamination of the interior of the apparatus. Attempts have been made to solve such problem by including, in the apparatus, a separate blade to clean the photosensitive drum, or by idly rotating the photosensitive drum a specified number of rounds prior to printing so as to clean the drum. However, installation of a separate blade causes increase in the cost of the apparatus and also generates toner waste. Furthermore, rotation of the photosensitive drum reduces printing speed.

Therefore, there is a need for the development of a method for preventing the contamination of a photosensitive drum in an image forming apparatus without waste of toner and without degrading printing speed.

The following patents are considered to be representative of the prior art, and are burdened by the disadvantages set forth herein: U.S. Pat. No. 5,500,720 to Karasawa, entitled *Bias Application Control Device For Image Forming Apparatus Using Reverse Development*, U.S. Pat. No. 5,339,141 to Suzuki et al., entitled *Developing Device With A Developer Carrier Capable Of Forming Numerous Microfields Thereon*, U.S. Pat. No. 5,309,207 to Omori, entitled *Apparatus For Forming Image*, U.S. Pat. No. 4,448,867 to Ohkubo et al., entitled *Image Forming Method And Device For Same*, U.S. Pat. No. 4,674,860 to Tokunaga et al., entitled *Image Transfer Device*, U.S. Pat. No. 4,444,864 to Takahashi, entitled *Method For Effecting Development By Applying An Electric Field Of Bias*, U.S. Pat. No. 4,330,199 to Komori et al., entitled *Electrophotographic Device*, U.S. Pat. No. 3,918,971 to Zweig, entitled *Method For Creating Multiple Electrostatic Copies By Persistent Conductivity*, U.S. Pat. No. 3,909,258 to Kotz, entitled *Electrographic Development Process*, U.S. Pat. No. 4,954,843 to Oka et al., entitled *Electrophotographic Image Forming Apparatus*, U.S. Pat. No. 4,870,460 to Harada et al, entitled *Method Of Controlling Surface Potential Of Photoconductive Element*, U.S. Pat. No. 3,722,992 to Zweig, entitled *Apparatus For Creating An Electrostatic Latent Image By Charge Modulation*, and U.S. Pat. No. 5,708,942 to Sugiyama et al., entitled *Developing Device For An Image Forming Apparatus*.

SUMMARY OF THE INVENTION

It is, therefore, an object of the present invention to provide a method for preventing contamination of a photosensitive drum in an image forming apparatus, wherein the apparatus does not generate waste of toner and has improved printing speed.

To achieve the above object, there is provided a method for preventing contamination of a photosensitive drum in an electrophotographic image forming apparatus. The method includes the steps of: cutting off a ground path between the photosensitive drum and a ground upon receiving an initial print command; initializing an exposure unit; providing a developing roller and a charging roller with high voltages, and rotating the photosensitive drum; checking whether an initial area of the photosensitive drum which initially contacted the charging roller has reached a developing position where the photosensitive drum contacts the developing roller; connecting the ground path between the photosensitive drum and the ground if the initial area of the photosensitive drum has reached the developing position; and performing a print operation according to print command.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
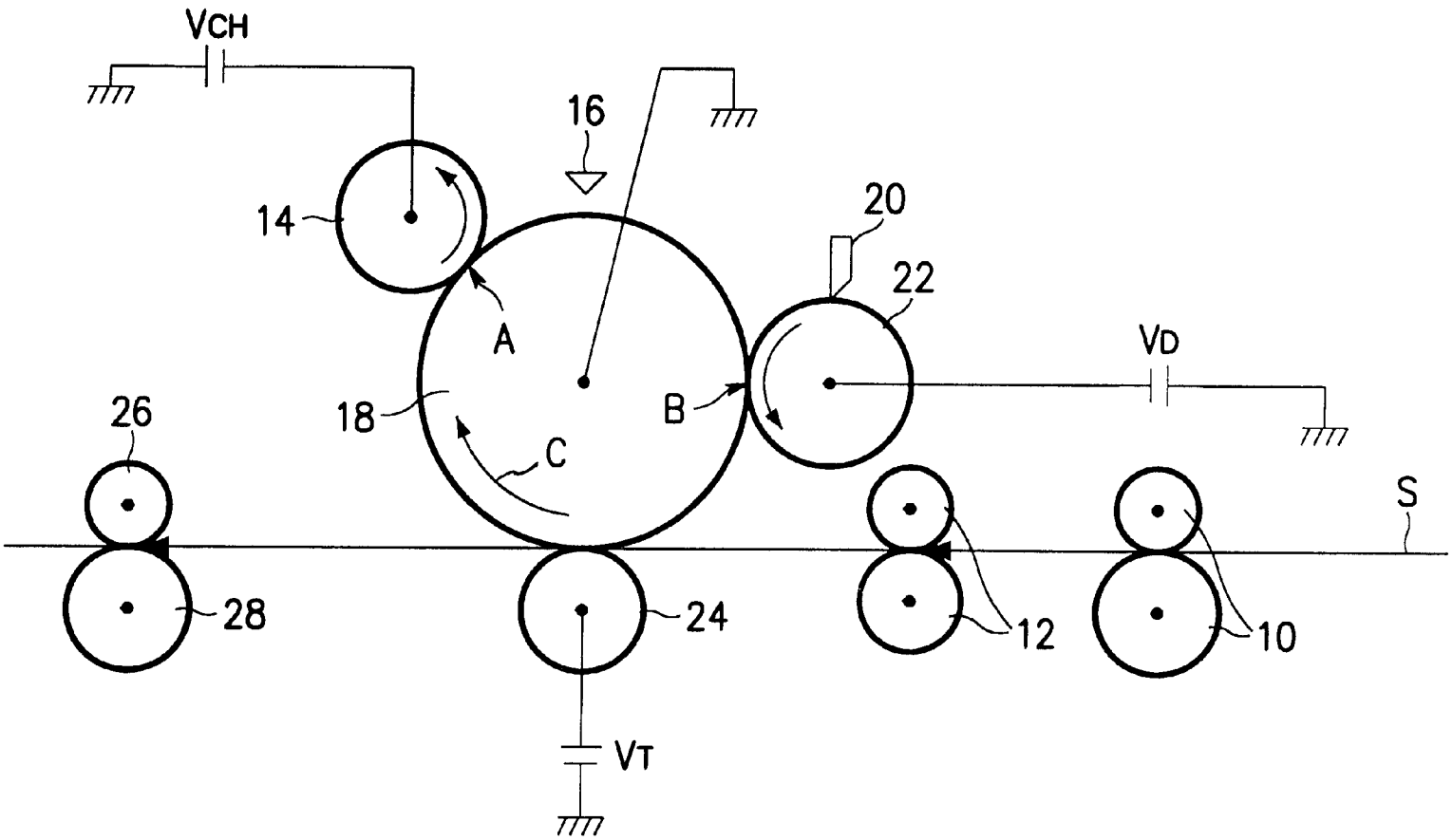
FIG. 1 is a schematic view illustrating an engine mechanism of an electrophotographic image forming apparatus.

The present invention will be described in detail with reference to the attached drawings. Like reference numerals denote the same components in the drawings, and a detailed description of related known function and structure of the present invention will be avoided if it is deemed to obscure the subject matter of the present invention.

FIG. 1 is a schematic view illustrating an engine mechanism of the electrophotographic image forming apparatus employing a contact charging technique. The contact charging technique, being widely used for the advantage that it can minimize generation of ozone due to charging, causes a conductive roller or brush used as a contact charging device to contact a photosensitive drum 18, thereby forming a uniform electric potential on the surface of the photosensitive drum 18. In particular, FIG. 1 shows the engine mechanism including a conductive roller 14 used as the contact charging device. In FIG. 1, the reference letter S represents a conveying path of a recording paper.

The electrophotographic process will be described in detail with reference to the engine mechanism of FIG. 1. The photosensitive drum 18 is rotated in the direction of arrow C by an engine driving motor (not shown), which is a main motor of the engine, in conformity with the progress of the processing steps of the electrophotographic process as described above.

First, in the charging step, the conductive roller 14 is negatively charged with a charge voltage $V_{CH}$. As the photosensitive drum 18 rotates, the conductive roller 14 charges the photosensitive drum 18 beginning at a charge location 'A' where the conductive roller 14 contacts the photosensitive drum 18. In this condition, conveyer rollers 10 convey the recording paper fed from a paper feed cassette (not shown) toward register rollers 12. The register rollers 12 align the front end of the recording paper being conveyed by the conveyer rollers 10 along the conveying path. As the exposing step begins after aligning the recording paper, the recording paper begins to be conveyed toward a transfer roller 24.

Second, in the exposing step, an exposure unit 16 irradiates a light beam corresponding to a document or image data on the surface of the charged photosensitive drum 18. As a result, an electrostatic latent image consisting of an unexposed region and an exposed region is formed on the surface of the photosensitive drum 18. In the case of the laser beam printer, the exposure unit 16 is a laser scanner. However, in case of the copier, the exposure unit 16 is a document scanner.

Third, in the developing step, a developing roller 22 is charged with a developing voltage $V_D$. Then, toner supplied from a toner cartridge (not shown) is deposited onto the developing roller 22. The toner deposited onto the developing roller 22 is regulated by a regulation blade 20. In this condition, the toner on the developing roller 22 moves to the exposed region on the photosensitive drum 18 by the potential difference between the photosensitive drum 18 and the developing roller 22, at a developing position 'B' where the photosensitive drum 18 contacts the developing roller 22.

Fourth, in the transferring step, the toner deposited onto the photosensitive drum 18 is transferred onto the recording paper by the transfer roller 24 to which a transfer voltage $V_T$ is applied.

Fifth, in the fixing step, a fixing unit consisting of a pressure roller 26 and a heat roller 28 applies pressure and heat to the toner transferred onto the recording paper so as to fix the toner image on the recording paper. After that, the recording paper is discharged from the image forming apparatus, thereby completing copying or printing for a sheet of the recording paper.

Here, when the printing begins initially, the surface of the photosensitive drum 18 is in an uncharged state. If the electrophotographic process begins in this situation, the photosensitive drum 18 rotates in the direction of arrow C, and then, the charging roller 14 charges the photosensitive drum 18 along the arrow direction beginning at the charge position 'A'. Accordingly, an area just before the charge position 'A' on the surface of the photosensitive drum 18 is not charged until the same area takes one round to reach the charge position 'A'. In this condition, the developing roller 22 and the photosensitive drum 18 rotate beginning at the developing position 'B'.

However, since the surface of the photosensitive drum 18 between the charge position 'A' and the developing position 'B' is not charged, the drifting toner deposited onto the developing roller 22 is transferred onto the photosensitive drum 18, thereby contaminating the photosensitive drum 18. Such contamination of the photosensitive drum 18 causes formation of the background image and the contamination in the interior of the apparatus.

On the contrary, in the condition that the photosensitive drum 18 is charged, the exposure unit 16 irradiates the photosensitive drum 18 with a light beam in order to initialize the exposure unit 16 itself. In this case, the area exposed to the light beam from the exposure unit 16 is located between the charging position 'A' and the developing position 'B'. As the exposed area on the photosensitive drum 18 contacts the developing roller 22, the toner on the developing roller 22 moves to the exposed area, which contaminates the photosensitive drum 18. Such contamination of the photosensitive drum 18 forms a background image or contaminates the interior of the apparatus.

In order to solve such a problem, the apparatus includes a separate blade to clean the photosensitive drum 18 or idly rotates the photosensitive drum 18 a specified number of rounds prior to printing so as to clean the photosensitive drum 18.

However, installing the separate blade to the apparatus causes an increase of the cost and generation of the waste toner. Further, rotating the photosensitive drum several rounds reduces the printing speed.

Figure 2:
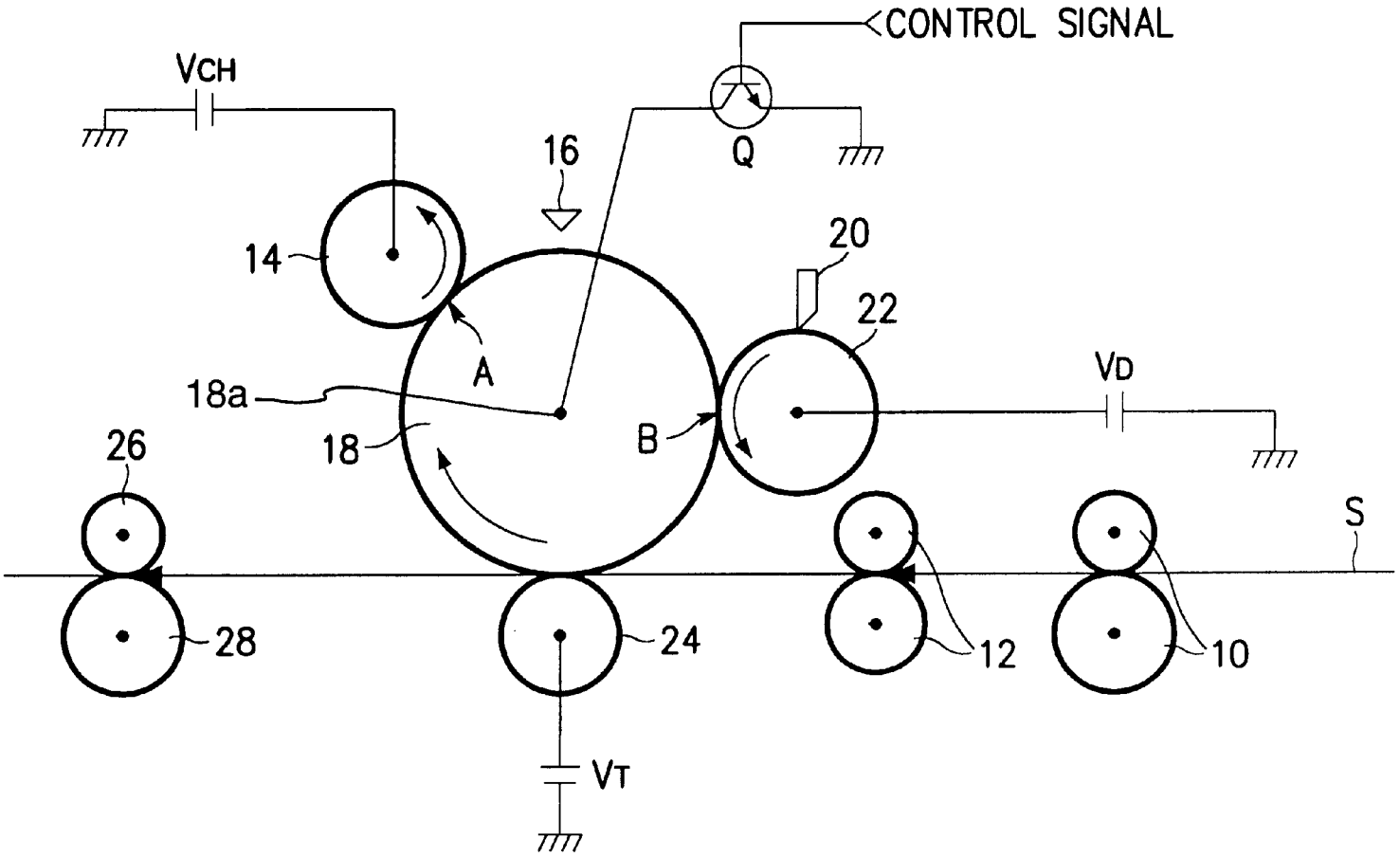
FIG. 2 is a schematic view illustrating an engine mechanism of an electrophotographic image forming apparatus according to a preferred embodiment of the present invention.

FIG. 2 schematically illustrates an engine mechanism of an electrophotographic image forming apparatus according to a preferred embodiment of the present invention. As illustrated, a transistor Q, being a switching element, is connected between a ground plate of the photosensitive drum 18 and ground. The transistor Q has an emitter connected to ground, a collector connected to a ground plate 18*a* of the photosensitive drum 18, and a base connected to receive a control signal. The transistor Q is turned on and off in response to the control signal. When the transistor Q is turned on, a path between the photosensitive drum 18 the ground is connected and, when the transistor Q is turned off, the path is cut off. From the foregoing descriptions and the accompanying drawings, it is apparent that the engine mechanism is unique and novel as a result of inclusion of the transistor Q.

Figure 3:
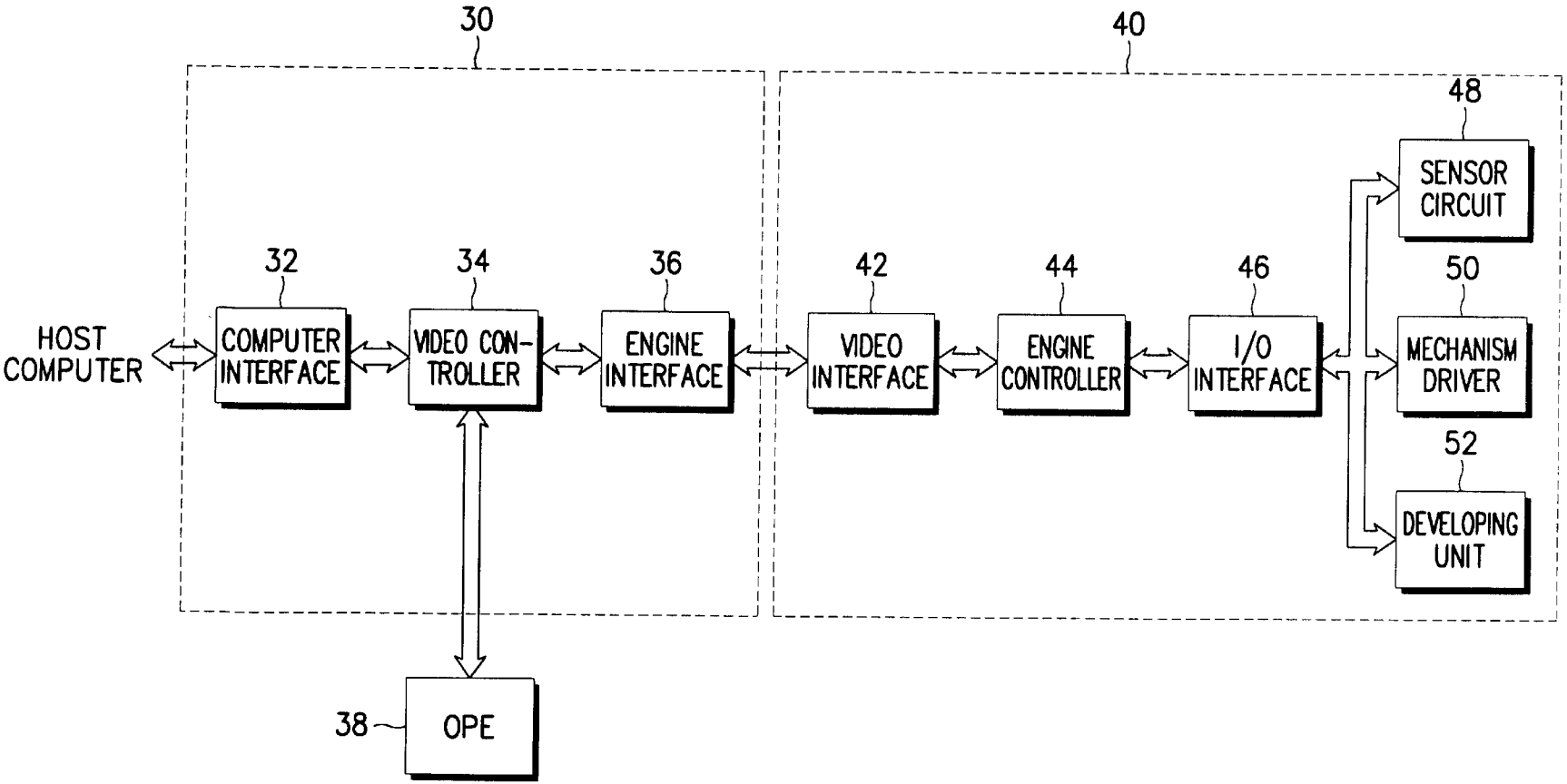
FIG. 3 is a block diagram of a laser beam printer applied to the present invention.

FIG. 3 shows a block diagram of a laser beam printer, which is a typical electrophotographic image forming apparatus, to which the present invention is applied. The laser beam printer is comprised of a video controller 30, a print engine 40, and an operating panel equipment (OPE) 38. The video controller 30 includes a computer interface 32, a video controller 34, and an engine interface 36. The computer interface 32 is connected between a host computer and the video controller 34, and interfaces transmission and reception signals between the host computer and the video controller 34. The video controller 34 includes a ROM (Read Only Memory) into which a control program is stored, and a RAM (Random Access Memory) for temporarily storing data. Further, the video controller 34 converts print data received from the host computer via the computer interface 32 into image data, and provide the converted image data to the print engine 40. The engine interface 36 interfaces input/output signals between the video controller 34 and the print engine 40.

The operating panel equipment 38 is controlled by the video controller 34, and includes a number of keys with which the user may input various commands and a display unit for displaying thereon display information according to operation of the laser beam printer.

The print engine 40 connected to the video controller 30 includes a video interface 42, an engine controller 44, an input/output (I/O) interface 46, a sensor circuit 48, a mechanism driver 50, and a developing unit 52. The video interface 42 interfaces input/output signals between the video controller 30 and the engine controller 44. The engine controller 44 controls the mechanism driver 50 and the developing unit 52 under the control of the video controller 30, and forms an image corresponding to the image data received from the video controller 30. Further, engine controller 44 senses each part of the print engine 40 by virtue of the sensor circuit 48. The I/O interface 46 is connected between the engine controller 44 and the sensor circuit 48, the mechanism driver 50 and the developing unit 52, and interfaces input/output signals of the engine controller 44. The sensor circuit 48 includes various sensors to sense operating status of each part of the print engine 40, feed and convey status of the paper and residual quantity of the toner, and provide the engine controller 44 with the sensing signals from the sensors. The mechanism driver 50 drives various mechanisms for feeding and conveying the paper and forming the image under the control of the engine controller 44. In particular, the mechanism driver 50 includes a main motor (not shown) for driving a plurality of the rollers shown in FIG. 2. The developing unit 52 includes the charging roller 14, the exposure unit 16, the photosensitive drum 18, the developing roller 22, the transfer roller 24, and the fixing rollers 26 and 28, and forms on paper the image corresponding to the image data by electrophotography under the control of the engine controller 44. A high voltage generator (not shown) provides high voltages to each of the rollers in the developing unit 52.

Figure 4:
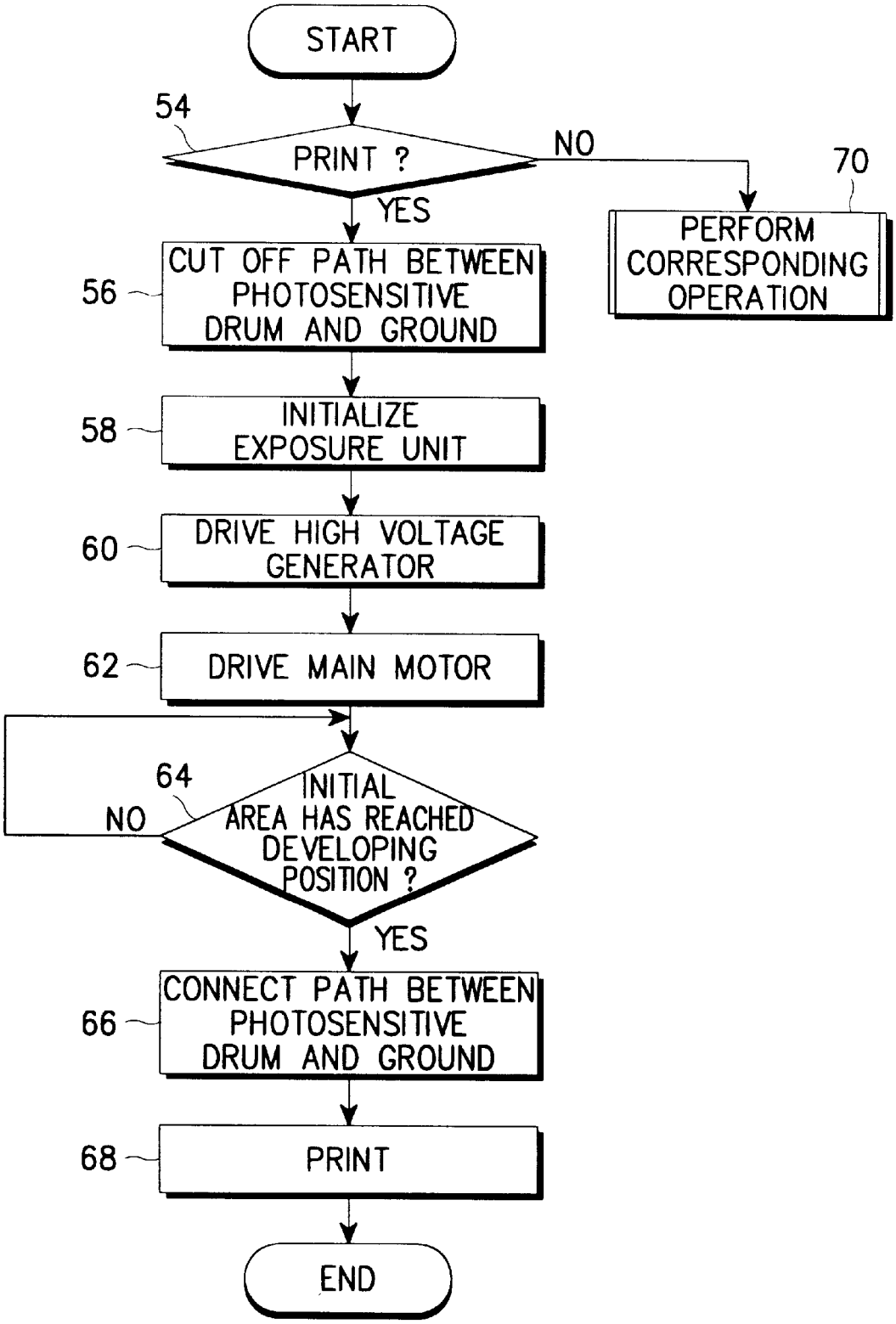
FIG. 4 is a flow chart for preventing contamination of a photosensitive drum according to a preferred embodiment of the present invention.

FIG. 4 is a flow chart for preventing contamination of a photosensitive drum 18 according to a preferred embodiment of the present invention. The engine controller 44 checks at step 54 whether an initial print command is received from the video controller 34. If the initial print command is received, the engine controller 44 performs step 56, and otherwise, performs step 70. At step 70, the engine controller 44 performs a corresponding operation.

At the step 56, the engine controller 44 provides a control signal of "LOW" state to the base of the transistor Q so as to cut off the path between the ground plate of the photosensitive drum 18 and ground. Accordingly, the surface of the photosensitive drum 18 does not have electric potential so that the toner is not transferred to the photosensitive drum 18.

After cutting off the path between the ground plate of the photosensitive drum 18 and the ground, the engine controller 44 initializes the exposure unit 16 at step 58. At this point, since the path between the ground plate of the photosensitive drum 18 and the ground is cut off, the photosensitive drum 18 will not have the potential variation on the surface thereof, even though it is exposed to the light beam.

After initializing the exposure unit 16, the engine controller 44 drives the high voltage generator for supplying high voltages to the respective rollers at step 60. As a result, the charging roller 14 is provided with the charging voltage $V_{CH}$, and the developing roller 22 is provided with the developing voltage $V_D$. Then, the engine controller 44 drives the main motor drive the respective rollers at step 62. As the main motor begins to be driven, the photosensitive drum 18 rotates. The engine controller 44 checks at step 64 whether the initial area of the photosensitive drum 18 which initially contacted the charging roller 14 has reached the developing position 'B'. If the initial area has reached the developing position 'B', the engine controller 44 proceeds to step 66; otherwise, the process returns to the step 64. The time required when the initial area reaches the developing position 'B' can be evaluated through experiments or calculation. That is, the engine controller 44 counts the time beginning at the driving start time of the main motor, to judge that the initial area has reached the developing position 'B' if a specified time has elapsed.

At step 66, the engine controller 44 provides a control signal of "HIGH" state to the base of the transistor Q to connect the path between the plate electrode of the photosensitive drum 18 and ground. Upon receiving the control signal of "HIGH" state, the transistor Q is turned on and, as a result, the plate electrode of the photosensitive drum 18 is connected to ground. Accordingly, the engine controller 44 prints an image corresponding to the image data provided by the video controller 30 at step 68.

In summary, the path between the ground plate of the photosensitive drum 18 and the ground is cut off, before the initial area of the photosensitive drum 18 which initially contacted the charging roller 14 reaches the developing position 'B'. Accordingly, the surface of the photosensitive drum 18 does not have an electric potential so that the toner will not be transferred to the photosensitive drum 18 until the uncharged area reaches the developing position 'B' or the area which is exposed during the initialization of the exposure unit reaches the developing position 'B'.

Accordingly, the image forming apparatus of the invention can prevent contamination of the apparatus and formation of the background image due to the initialization of the exposure unit without adding the separate blade or idly rotating the photosensitive drum several rounds. In this manner, it is possible to reduce the cost of the apparatus and improve the print speed.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A method for preventing contamination of a photosensitive drum in an electrophotographic image forming apparatus, comprising the steps of:

cutting off a ground path between said photosensitive drum and ground upon receiving an initial print command;

initializing an exposure unit;

providing a developing roller and a charging roller with high voltages;

rotating said photosensitive drum;

checking whether an initial area of said photosensitive drum which initially contacts said charging roller has reached a developing position where said photosensitive drum contacts said developing roller;

connecting said photosensitive drum to ground if said initial area of the photosensitive drum has reached said developing position; and performing a print operation according to a print command.

2. The method as claimed in claim 1, wherein said ground path is cut off by turning off a switching element connected between a ground plate of the photosensitive drum and ground.

3. The method as claimed in claim 2, wherein said ground path is connected by turning on said switching element connected between the ground plate of the photosensitive drum and ground.

4. An electrophotographic image forming apparatus, comprising a photosensitive drum, a charging roller contacting said photosensitive drum at a charging position, and a developing roller contacting said photosensitive drum at a developing position;

wherein said apparatus further comprises high voltage means for providing a high voltage to said charging roller, and additional high voltage means for providing a high voltage to said developing roller;

wherein said apparatus further comprises switch means connected between said photosensitive drum and electrical ground for selectively connecting and non-connecting said photosensitive drum to electrical ground; and wherein said switch means connects said photosensitive drum to electrical ground when an initial area of said photosensitive drum has reached said developing position.

5. The apparatus as claimed in claim 4, wherein said initial area of said photosensitive drum initially contacts said charging roller.

6. The apparatus as claimed in claim 4, wherein said switch means disconnects said photosensitive drum from electrical ground upon receipt of an initial print command.

7. An electrophotographic image forming apparatus, comprising a photosensitive drum, a charging roller contacting said photosensitive drum at a charging position, and a developing roller contacting said photosensitive drum at a developing position;

wherein said apparatus further comprises high voltage means for providing a high voltage to said charging roller, and additional high voltage means for providing a high voltage to said developing roller;

wherein said apparatus further comprises switch means connected between said photosensitive drum and electrical ground for selectively connecting and non-connecting said photosensitive drum to electrical ground; and wherein said switch means disconnects said photosensitive drum from electrical ground upon receipt of an initial print command.

8. An electrophotographic image forming apparatus, comprising:

a photosensitive drum;

a charging roller contacting said photosensitive drum at a charging position;

a developing roller contacting said photosensitive drum at a developing position; and switch means connected between said photosensitive drum and electrical ground for selectively connecting and non-connecting said photosensitive drum to electrical ground;

wherein said switch means connects said photosensitive drum to electrical ground when an initial area of said photosensitive drum has reached said developing position.

9. The apparatus as claimed in claim 8, wherein said initial area of said photosensitive drum initially contacts said charging roller.

10. The apparatus as claimed in claim 8, wherein said switch means disconnects said photosensitive drum from electrical ground upon receipt of an initial print command.

11. An electrophotographic image forming apparatus, comprising:

a photosensitive drum;

a charging roller contacting said photosensitive drum at a charging position;

a developing roller contacting said photosensitive drum at a developing position; and switch means connected between said photosensitive drum and electrical ground for selectively connecting and non-connecting said photosensitive drum to electrical ground;

wherein said switch means disconnects said photosensitive drum from electrical ground upon receipt of an initial print command.

* * * * *